United States Patent [19]

Baril et al.

[11] Patent Number: 4,507,632

[45] Date of Patent: Mar. 26, 1985

[54] ELECTROMAGNETIC WAVE SWITCH

[75] Inventors: Michel Baril; Gilles Sillard, both of Paris, France

[73] Assignee: Thomson-CSF, Paris, France

[21] Appl. No.: 410,708

[22] Filed: Aug. 23, 1982

[30] Foreign Application Priority Data

Aug. 21, 1981 [FR] France ..... 81 16120

[51] Int. Cl.[3] ..... H01P 1/15

[52] U.S. Cl. ..... 333/258; 333/103; 333/239; 333/248

[58] Field of Search ..... 333/103, 239, 248, 250, 333/251, 258

[56] References Cited

U.S. PATENT DOCUMENTS

| | | | |
|---|---|---|---|
| 2,951,217 | 8/1960 | Clapp . | |
| 3,050,702 | 8/1962 | Kibler . | |
| 3,155,923 | 11/1964 | Persson | 333/258 X |
| 3,346,825 | 10/1967 | Scott et al. . | |
| 3,553,610 | 1/1971 | Brenner et al. | 333/250 X |
| 3,701,055 | 10/1972 | Stiles | 333/258 X |
| 3,710,286 | 1/1973 | Aizu et al. | 333/258 X |
| 3,720,890 | 3/1973 | Anderson | 333/248 |

FOREIGN PATENT DOCUMENTS 2185866 1/1974 France .

OTHER PUBLICATIONS

IEEE Transactions on Microwave Theory and Techniques, vol. MTT-10, No. 1, Jan. 1962, W. J. Getsinger: "Ridge Wave-Guide Field Description and Application to Directional Couplers", pp. 41-50.

*Primary Examiner*—Paul Gensler

*Attorney, Agent, or Firm*—Oblon, Fisher, Spivak, McClelland & Maier

[57] ABSTRACT

An electromagnetic wave switch is provided formed from a profiled wave-guide associated with a PIN diode, filling completely the profiled part of said guide, having a high breakdown voltage and a low thermal resistance.

6 Claims, 6 Drawing Figures

ELECTROMAGNETIC WAVE SWITCH

BACKGROUND OF THE INVENTION

The invention relates to an electromagnetic wave switch formed from a semiconductor placed in a wave-guide and operating for millimeter waves. The object of such a device is to transmit certain micro-wave frequency signals and to attenuate others.

The prior art supplies examples of construction of micro-wave frequency switches, formed more particularly from a PIN diode associated with a biassing circuit and mounted in a wave-guide. FIG. 1 shows in cross section a rectangular wave-guide 1 comprising a PIN diode 2 placed on one of the internal faces 3 of the guide. The biassing voltage V for the diode is fed through a coaxial line 4 which is connected to the case of the diode through an micro-wave frequency trap 5 and a metal bar 6, the trap being separated from the coaxial line by a piece of insulation 50. The operation of such a switch is the following: when the diode is disabled, it is equivalent with its biassing circuit to a parallel resonating circuit, whereas when it is conducting, it is equivalent to a series resonating circuit, thus letting through the micro-wave frequency signal propagated in the wave-guide or attenuating it.

There exist another type of micro-wave frequency switch, related to the preceding one, and comprising a PIN diode. It operates in mode 2, that is to say that the PIN diode and its circuit present a series resonating circuit when the diode is disabled and a parallel resonating circuit when it is conducting.

Two main disadvantages appear during operation of this kind of switch. One is due to the fact that the cases protecting the PIN diodes as well as the different elements, such as the metal bar which provides both mechanical mounting and the bias input for the diode, are inductive or capacitive parasite elements limiting the operating pass-band of the switch.

The other disadvantage is due to the impossibility of using such a switch for millimeter waves. In fact, for the proper operation of the switch, a PIN diode is necessary having a very small junction capacity, which is very difficult to achieve and which may cause poor power behavior because of too low a breakdown voltage and/or a poor thermal resistance of the diode.

SUMMARY OF THE INVENTION

The object of the present invention is a millimeter electromagnetic wave switch, made from wave-guides, avoiding the above-mentioned drawbacks.

According to the invention, the electromagnetic wave switch is formed by a rectangular wave-guide whose dimensions allow the propagation of millimeter waves comprising a step providing a so-called ridged space, of given volume, in which is disposed a bar of semiconductor material with high breakdown voltage and low thermal resistance, whose volume is identical to that of the ridged space.

BRIEF DESCRIPTION OF THE DRAWINGS

Other features and advantages of the invention will appear from the following description, illustrated by FIGS. 1 to 6 wherein.

DESCRIPTION OF THE PREFERRED EMBODIMENTS

Figure 1:
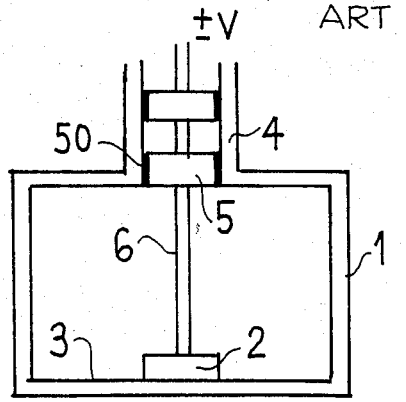
FIG 1 PRIOR ART
FIG. 1 shows a prior art switch discussed previously.
Figure 2:
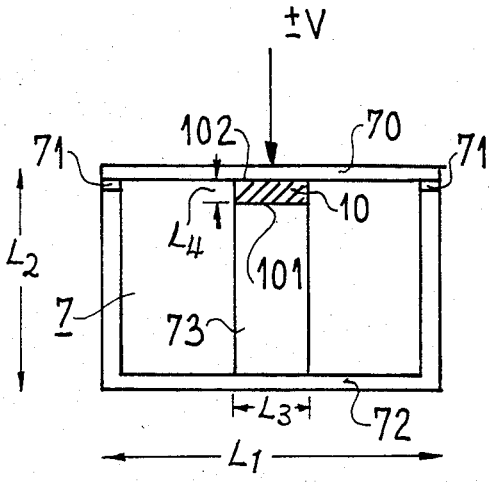
FIG. 2, a sectional view of a switch along a cross-section of the guide.

FIG. 2 shows a switch in accordance with the invention, seen in cross section. It is formed from a rectangular wave-guide constructed in two parts, one being a flat metal plate 70 and the other being a metal plate in the form of a U, these two plates forming the cavity of the wave-guide when joined together. They are insulated from each other by an insulating material layer 71. Part 72 comprises a step 73 in its central part, providing in the guide a so-called ridged space, in which the electric field is concentrated. In this ridged space there is disposed a semiconductor bar 10 with high breakdown voltage—several hundreds of volts—and a low thermal resistance, this bar having a volume identical to the volume defined by the ridged space.

Given the dimensions of the wave-guide operating in millimeter waves, a semiconductor chip such as a PIN diode can be placed in the ridged space. In a particular embodiment, the dimensions of the cross section of guide 7 are:

$$L_1 = 2.54 \text{ mm and } L_2 = 1.27 \text{ mm}$$

and those of the ridged space are:

$$L_3 = 0.6 \text{ mm and } L_4 = 0.4 \text{ mm}$$

The cathode 101 of diode 10 is connected to the step 73 whereas its anode 102 is connected to the other part 70. To bias the diode, a voltage $\pm V$ is applied between these two parts.

Thus, when the diode is disabled, the guide, on the one hand may be considered as being filled with a dielectric material having a high constant dielectric $\epsilon$ ($\epsilon \sim 12$ for a PIN diode) and on the other hand having dimensions such that the propagation of a millimeter wave is possible. In this case, such a wave is transmitted through the switch.

On the other hand, when the diode is conducting, it is equivalent to a short-circuit and the incident millimeter wave is reflected by the switch.

In so far as the practical construction is concerned a conventional PIN diode is used whose dimensions are adjusted to those of the guide and whose two faces are metalized. To ensure good heat dissipation, the metalized faces of the diode are soldered to the walls of the guide.

Figure 3:
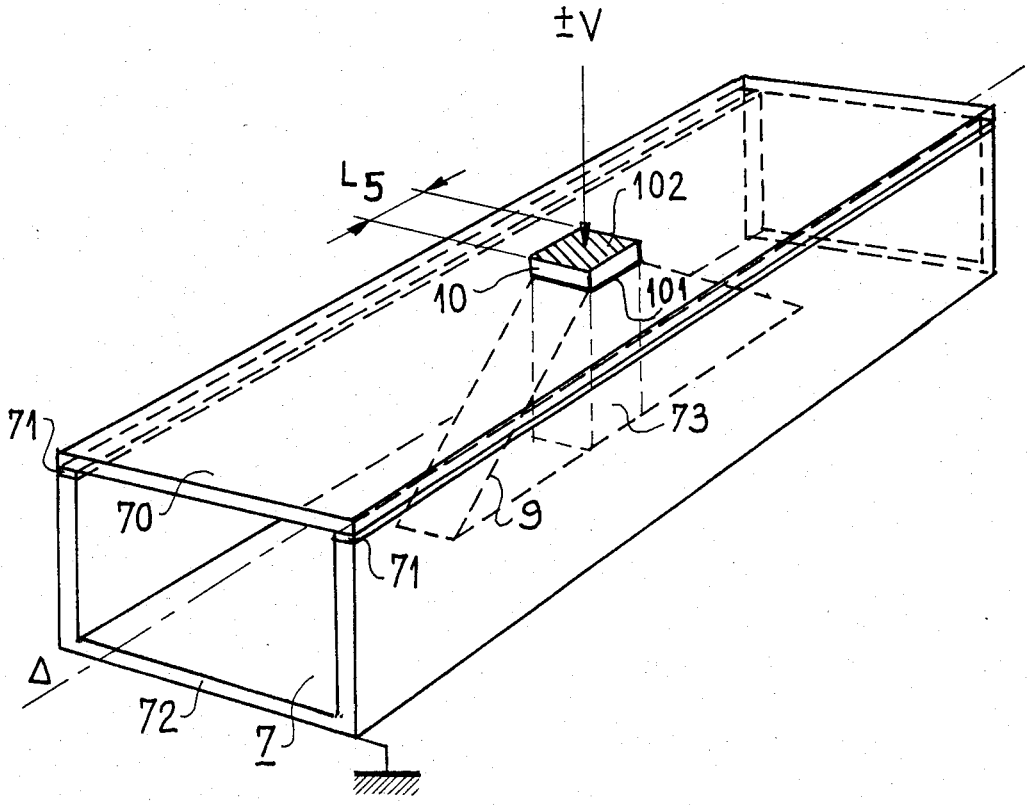
FIG. 3, a perspective view of the switch of FIG. 2.

FIG. 3 shows a switch in accordance with the invention, in a perspective view. The elements identical to those of FIG. 2 perform the same functions and bear the same references. Between the ridged space and the wave-guide, the transitions are ensured by tapers 9 which are equivalent to transformers matching the discontinuities. In order to further compensate for these transitions, the dimension of the PIN diode 10, $L_5$, along the longitudinal axis $\Delta$ of the wave-guide, is a multiple of a quarter of the guided wave-length $\lambda$ g at the central frequency of the operating band. Preferably, this dimension is equal to $3\lambda g/4$ rather than $\lambda$ g/4 for the dimension of the PIN diodes generally used is of the order of 0.6 to 0.7 mm.

Figure 4:
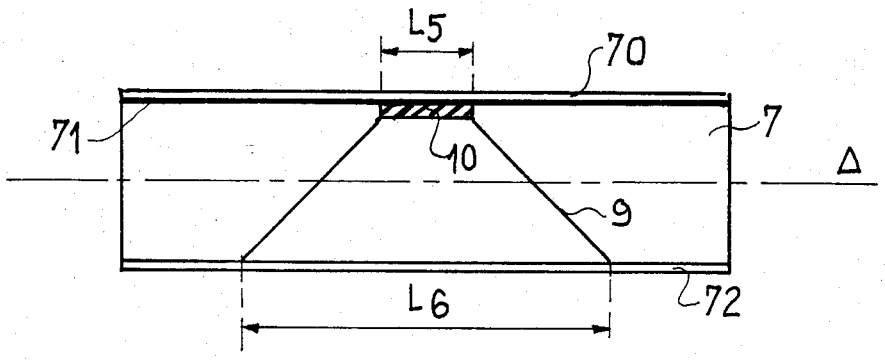
FIG. 4 a longitudinal sectional view of the switch of the preceding figures.

FIG. 4 is a view in longitudinal section of wave-guide 7, comprising the same references as the preceding figures. There are shown in addition the dimensions, along axis Δ, of the PIN diode 10 and of the tapers 9.

According to the embodiment already mentioned, lengths $L_5$ and $L_6$ assume the following values:

$$L_5=0.7 \text{ mm and } L_6=15 \text{ mm}$$

Figure 5:
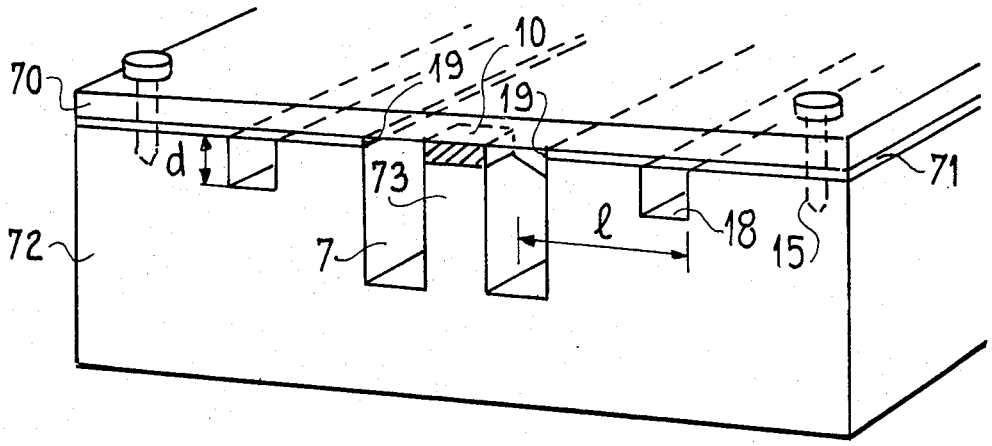
FIG. 5, a variation of a switch according to the invention shown in section.

In FIG. 5 is shown a particular embodiment of a switch in accordance with the invention. The two parts 70 and 72, separated by the insulation 71, are screwed together by means of nylon screws 15 for example. So as to ensure the microwave contacts, in addition to the insulating layer 71, a furrow 18 has been provided on each side of the guide, at a distance $1=(2n+1)\lambda/4$ of the guide and over the whole length of the guide, serving as a microwave trap. These two traps 18, whose depth d is a multiple of $\lambda/4$ cause an open circuit at the level of the insulating plate, so a short-circuit at the edges 19 of the wave-guide. This electric short-circuit provides continuity from the microwave point of view being insulating from the DC point of view.

Thus there has just been described a millimeter electromagnetic wave switch having good power behavior. With respect to prior devices, the number of elements in the circuit are considerably reduced and the semiconductors used are semiconductors operating in much lower frequency ranges and having a high breakdown voltage and a low thermal resistance.

Figure 6:
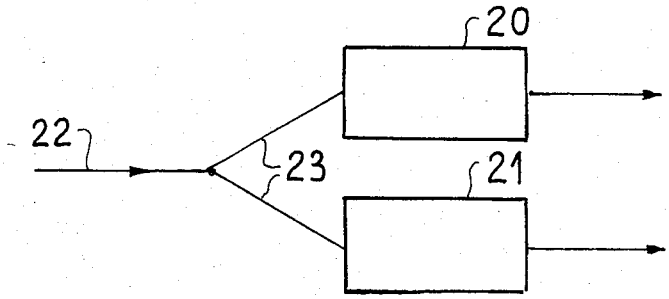
FIG. 6, a device using a switch in accordance with the invention.

This device may be used in any system where it is required to attenuate or switch an electromagnetic signal. Thus, it may either protect a receiver by acting as a controlled protection circuit, or be associated with a directional filter for switching a signal into a given channel. This is what is shown in FIG. 6: two switches 20 and 21 are connected to an input channel 22 through two microwave lines 23 whose length is equal to an uneven multiple of a quarter of the guided wavelength λ g. When switch 20 is enabled, the other switch 21 is disabled, and thus a signal fed over channel 22 is directed towards switch 20 and conversely when the switch 20 is disabled, the switch 21 is enabled.

What is claimed is:

1. An electromagnetic wave switch formed by a rectangular wave-guide having a longitudinal axis associated with a semiconductor, wherein said wave-guide has dimensions which allow propagation of millimeter waves, said wave-guide switch comprising:

a step centrally formed in said wave-guide and defining a ridged space, of given volume;

a bar of semiconductor material disposed in said ridged space of said wave-guide formed by said step, said bar having a high breakdown voltage and low thermal resistance wherein the volume of said bar is identical to that of said ridged space and wherein said wave-guide is formed in a first and a second part with said first part being a flat metal plate and said second part being a U-shaped metal plate on which said step is formed so that the joining together of said first and second parts form the cavity of the wave-guide and said first and second parts are insulated by a layer of insulating material.

2. The switch as claimed in claim 1, wherein said semiconductor bar is a PIN diode whose two metalized faces are respectively soldered, one to said flat metal plate and the other to said step of said guide.

3. The switch as claimed in claim 2, wherein tapering impedance transformers ensure the transitions between said wave-guide and said step.

4. The switch as claimed in claim 2, wherein the dimension of said PIN diode along said longitudinal axis is an odd multiple of a quarter of the wave-length at the central frequency of the operating band.

5. The switch as claimed in claim 1, wherein said U shaped metal plate of said guide comprising said step comprises, outside said cavity, two furrows on each side of said axis, at a given distance from said guide, said two furrows being formed to a given depth and over the whole length of the switch, thus serving as microwave traps.

6. The switch as claimed in claim 5, wherein said distance and said depth are multiples of a quarter of the wave-length at the central frequency of the operating band.

* * * * *